US010845123B2

(12) United States Patent
Hong et al.

(10) Patent No.: US 10,845,123 B2
(45) Date of Patent: Nov. 24, 2020

(54) RAW MATERIAL SUPPLY DEVICE, FLASH SMELTING FURNACE AND NOZZLE MEMBER

(71) Applicant: PAN PACIFIC COPPER CO., LTD., Tokyo (JP)

(72) Inventors: Jae Hyung Hong, Oita (JP); Tatsuya Motomura, Oita (JP); Yuki Soma, Oita (JP); Eitaro Adachi, Oita (JP)

(73) Assignee: PAN PACIFIC COPPER CO., LTD., Tokyo (JP)

( * ) Notice: Subject to any disclaimer, the term of this patent is extended or adjusted under 35 U.S.C. 154(b) by 60 days.

(21) Appl. No.: 15/941,197

(22) Filed: Mar. 30, 2018

(65) Prior Publication Data

US 2018/0283790 A1 Oct. 4, 2018

(30) Foreign Application Priority Data

Mar. 31, 2017 (JP) ..... 2017-072344

(51) Int. Cl.
*F27D 3/18* (2006.01)
*C22B 15/00* (2006.01)
(Continued)

(52) U.S. Cl.
CPC ..... *F27D 3/18* (2013.01); *C22B 15/0047* (2013.01); *F27B 1/16* (2013.01); *F27B 1/26* (2013.01);
(Continued)

(58) Field of Classification Search
CPC ..... C22B 15/0047; F27B 1/16; F27B 1/26; F27D 2003/169; F27D 3/18
(Continued)

(56) References Cited

U.S. PATENT DOCUMENTS 8,147,747 B2 * 4/2012 Wang ..... C22B 13/02 110/182.5
8,206,643 B2 * 6/2012 Sipila ..... C22B 15/0047 266/175
(Continued)

FOREIGN PATENT DOCUMENTS

CN 103453774 A 12/2013
CN 104634101 A 5/2015
(Continued)

OTHER PUBLICATIONS

Japanese Notice of Reasons for Refusal for counterpart Japanese Application No. 2017-072344, dated Jul. 2, 2019, with English translation.
(Continued)

*Primary Examiner* — Scott R Kastler
*Assistant Examiner* — Michael Aboagye
(74) *Attorney, Agent, or Firm* — Birch, Stewart, Kolasch & Birch, LLP

(57) ABSTRACT

A raw material supply device that supplies a raw material into a flash smelting furnace and supplies first gas and second gas into the flash smelting furnace, includes: a first gas pathway that is provided in a lance and supplies the first gas into the flash smelting furnace; a raw material pathway that is provided out of the lance and supplies the raw material into the flash smelting furnace; a second gas pathway that is provided out of the raw material pathway and supplies the second gas into the flash smelting furnace; and a blade that is provided in the first gas pathway, has an inclined face with which the first gas is collided and revolves the first gas toward a lower side of the flash smelting furnace, the inclined face being inclined with respect to a flow direction of the first gas in the first gas pathway.

2 Claims, 7 Drawing Sheets

(51) Int. Cl.
*F27B 1/16* (2006.01)
*F27B 1/26* (2006.01)
*F27D 3/16* (2006.01)

(52) U.S. Cl.
CPC .. *F27D 2003/162* (2013.01); *F27D 2003/169* (2013.01)

(58) Field of Classification Search
USPC ..... 266/175, 221, 182, 216, 266, 265, 267; 75/455, 454, 639, 694, 414
See application file for complete search history.

(56) References Cited

U.S. PATENT DOCUMENTS 8,287,801 B2 * 10/2012 Yasuda ..... C22B 9/05 266/175
9,034,243 B2 * 5/2015 Sipila ..... F27D 3/16 266/44
2007/0205543 A1 * 9/2007 Lanyi ..... C21B 5/001 266/176
2010/0107821 A1 5/2010 Wang et al.
2010/0207307 A1 8/2010 Sipilä et al.
2011/0074070 A1 3/2011 Yasuda et al.
2016/0237522 A1 8/2016 Zhou et al.

FOREIGN PATENT DOCUMENTS

CN 104634102 A 5/2015
JP 60-248832 A 12/1985
JP 2010-538162 A 12/2010
JP 2011-75228 A 4/2011

OTHER PUBLICATIONS

Japanese Notice of Reasons for Refusal for counterpart Japanese Application No. 2017-072344, dated Mar. 10, 2020, with an English translation.

* cited by examiner

RAW MATERIAL SUPPLY DEVICE, FLASH SMELTING FURNACE AND NOZZLE MEMBER

CROSS-REFERENCE TO RELATED APPLICATION

This application is based upon and claims the benefit of priority of the prior Japanese Patent Application No. 2017-072344, filed on Mar. 31, 2017, the entire contents of which are incorporated herein by reference.

FIELD

The present invention relates to a raw material supply device, a flash smelting furnace and a nozzle member.

BACKGROUND

A flash smelting furnace is used for a smelting of non-iron metal such as copper, nickel or the like and a matte-treating smelting. The flash smelting furnace has a shaft above a settler of a reverberatory furnace type. When a raw material and gas for reaction are blown from a top of the shaft, the raw material is instantly oxidized and melted by oxidation heat of the raw material. In the flash smelting furnace, a device for supplying the raw material and the gas for reaction has an important role for determining performance of the flash smelting furnace. The performance of the raw material supply device has large influence on the reaction efficiency of the raw material in the reaction shaft and a reaction progress degree. Therefore, the performance of the raw material supply device has large influence on the treating performance of the flash smelting furnace and a metal collection rate. It is preferable that the reaction in the reaction shaft in the flash smelting furnace is speedy and the reaction of all of the raw material evenly progresses with the same reaction progress degree. It is preferable that the raw material and the gas for reaction are evenly mixed with each other.

There is known a technology in which a main blow supplied into the reaction shaft from the raw material supply device is revolved in order to improve the mixing of the raw material and the gas for reaction (see Japanese Patent Application Publication No. 2010-538162). There is known a technology in which a pipe for blowing oxygen is provided so as to surround a fuel burner in a pipe-shaped concentrate shoot and a revolved flow is supplied by providing a guiding blade in an opening of the pipe for blowing oxygen (see Japanese Patent Application Publication No. S60-248832).

SUMMARY

A temperature of a region just below the raw material supply device is low because of the main blow. Therefore, it is difficult to promote reaction of the concentrate in the region. Neither Japanese Patent Application Publication No. 2010-538162 nor Japanese Patent Application Publication No. S60-248832 positively generates a revolved flow in the region just below the raw material supply device. There is a room for improvement.

It is an object to provide a raw material supply device, a flash smelting furnace and a nozzle member that are capable of positively promoting mixing of a raw material supplied in a flash smelting furnace and gas for reaction and uniformizing reaction.

According to an aspect of the present invention, there is provided a raw material supply device that supplies a raw material into a flash smelting furnace and supplies first gas and second gas into the flash smelting furnace, the first gas and the second gas contributing to reaction of the raw material, including: a first gas pathway that is provided in a lance and supplies the first gas into the flash smelting furnace; a raw material pathway that is provided out of the lance and supplies the raw material into the flash smelting furnace; a second gas pathway that is provided out of the raw material pathway and supplies the second gas into the flash smelting furnace; and a blade that is provided in the first gas pathway, has an inclined face with which the first gas is collided and revolves the first gas toward a lower side of the flash smelting furnace, the inclined face being inclined with respect to a flow direction of the first gas in the first gas pathway.

The blade may be provided at a lower edge of the first gas pathway. The blade may be provided between a ring-shaped frame provided in the first gas pathway and a hub portion provided in a center portion of the frame portion.

According to an another aspect of the present invention, there is provided a flash smelting furnace including the above-mentioned raw material supply device.

According to an another aspect of the present invention, there is provided a nozzle member including: a ring-shaped frame portion; a hub portion that is provided in a center portion of the frame portion; and a plurality of blades that are radially arranged around the hub portion, connects the frame portion and the hub portion, and has an inclined face that is inclined with respect to an axis direction of the hub portion.

DESCRIPTION OF EMBODIMENTS

Figure 1:
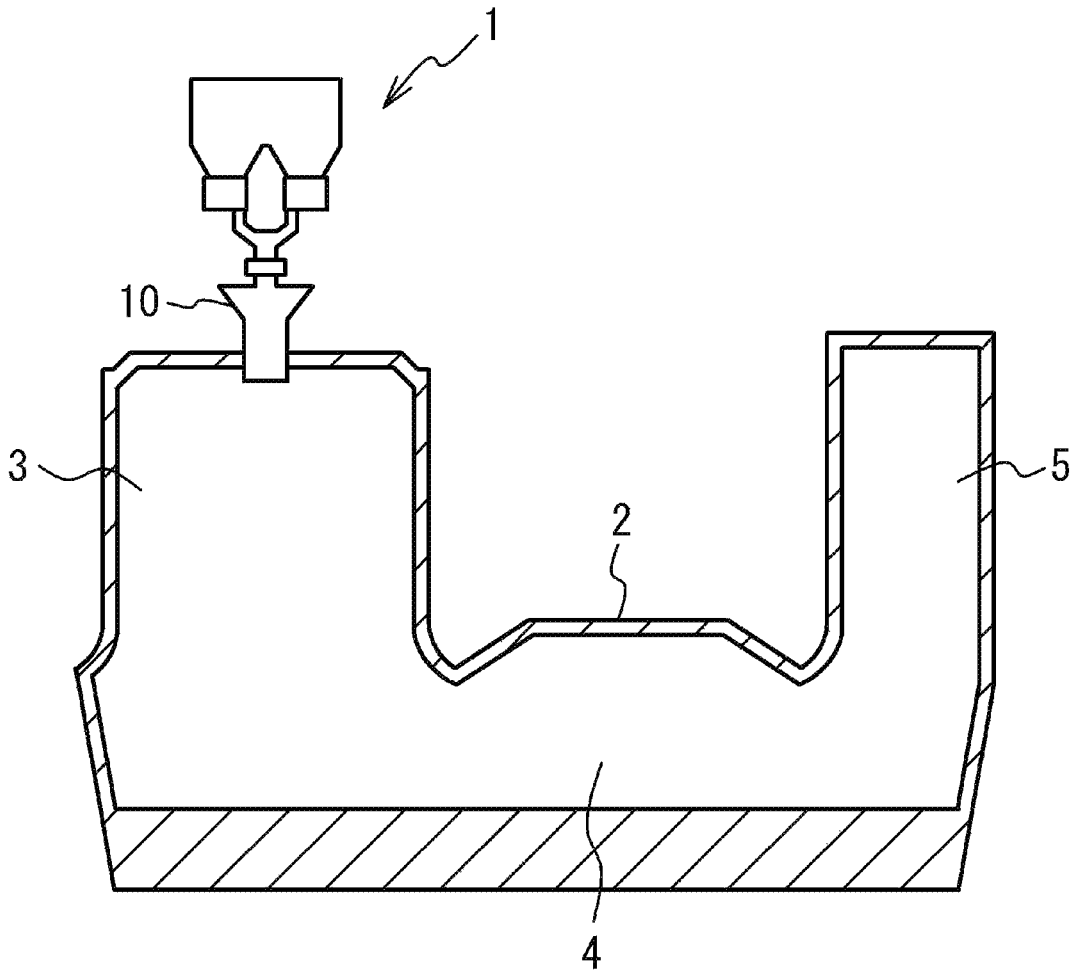
FIG. 1 illustrates a schematic structure of a flash smelting furnace for copper smelting in accordance with an embodiment.

A description will be given of details of a flash smelting furnace in accordance with an embodiment, on the basis of FIG. 1 to FIG. 7. FIG. 1 illustrates a schematic view of a flash smelting furnace 100 for copper smelting in accordance with the embodiment.

First Embodiment

As illustrated in FIG. 1, the flash smelting furnace 100 has a raw material supply device 1 and a furnace body 2. The raw material supply device 1 is also called a concentrate burner. The raw material supply device 1 supplies concentrate that is the raw material (such as copper concentrate $CuFeS_2$ or the like), main blow gas for reaction, auxiliary gas for reaction, and gas for dispersion (contributing to the reaction) into the furnace body 2. The furnace body 2 has a reaction shaft 3, a settler 4 and an uptake 5. In the reaction shaft 3, the concentrate is mixed with the gas for reaction. The main blow gas for reaction and the auxiliary gas for reaction are oxygen-rich air. The gas for reaction and the gas for dispersion disperse the concentrate and oxidizes the concentrate. The gas for reaction and the gas for dispersion generate matte and slag on a bottom of the reaction shaft 3.

Figure 2:
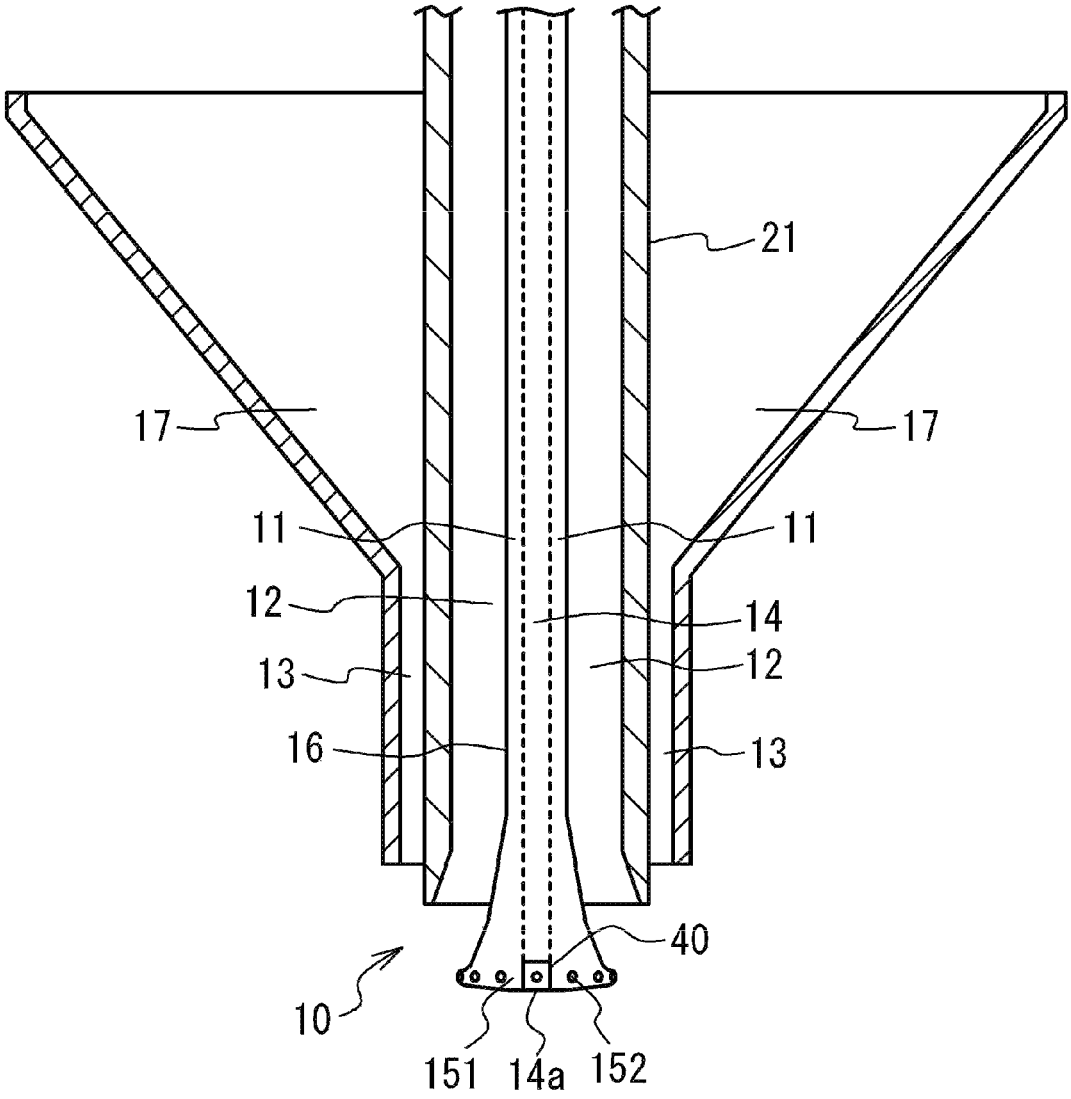
FIG. 2 illustrates an enlarged view of a raw material supply device of an embodiment.

FIG. 2 illustrates an enlarged view of the raw material supply device 1. FIG. 2 also illustrates a supplier 10 for supplying the raw material, the gas for reaction and the gas for dispersion into the reaction shaft 3.

The supplier 10 of the raw material supply device 1 has a lance 16. The lance 16 has a first pathway 11 through which the gas for dispersion passes and a fourth pathway 14 through which the auxiliary gas for reaction passes as first gas. The fourth pathway 14 is formed in a center portion of the lance 16. The first pathway 11 is formed around the fourth pathway 14. The supplier 10 has a second pathway 12 as a raw material pathway. The second pathway 12 is formed out of the lance 16. In concrete, the second pathway 12 is formed around an external circumference of the lance 16. The supplier 10 has a third pathway 13 through which the main blow for reaction passes as second gas. The third pathway 13 is formed out of the second pathway 12. In concrete, the third pathway 13 is formed around an external circumference of the second pathway 12. The fourth pathway 14 acts as a first gas pathway. The third pathway 13 acts as a second gas pathway. The third pathway 13 is formed with a pipe-shaped member surrounding the second pathway 12 and communicates with an air chamber 17 that is arranged above the third pathway 13 and has a funnel shape. The second pathway 12 and the third pathway 13 are separated from each other by a section wall 21 having a cylindrical shape.

The first pathway 11 supplies the gas for dispersion into the reaction shaft 3. The second pathway 12 supplies the concentrate into the reaction shaft 3. The third pathway 13 supplies the main blow gas for reaction into the reaction shaft 3 from the air chamber 17. The fourth pathway 14 supplies the auxiliary gas for reaction into the reaction shaft 3.

A dispersion cone 15 is formed at an edge (lower edge) of the lance 16. The dispersion cone 15 has a hollow structure and has a circular truncated cone shape. A side lower portion 151 of the dispersion cone 15 has a plurality of through holes 152. The gas for dispersion passes through the first pathway 11. After that, the plurality of through holes 152 supply the gas for dispersion into the reaction shaft 3. The through holes 152 are formed so that a supply direction of the gas is a normal direction of a bottom circle of the dispersion cone 15.

Figure 3:
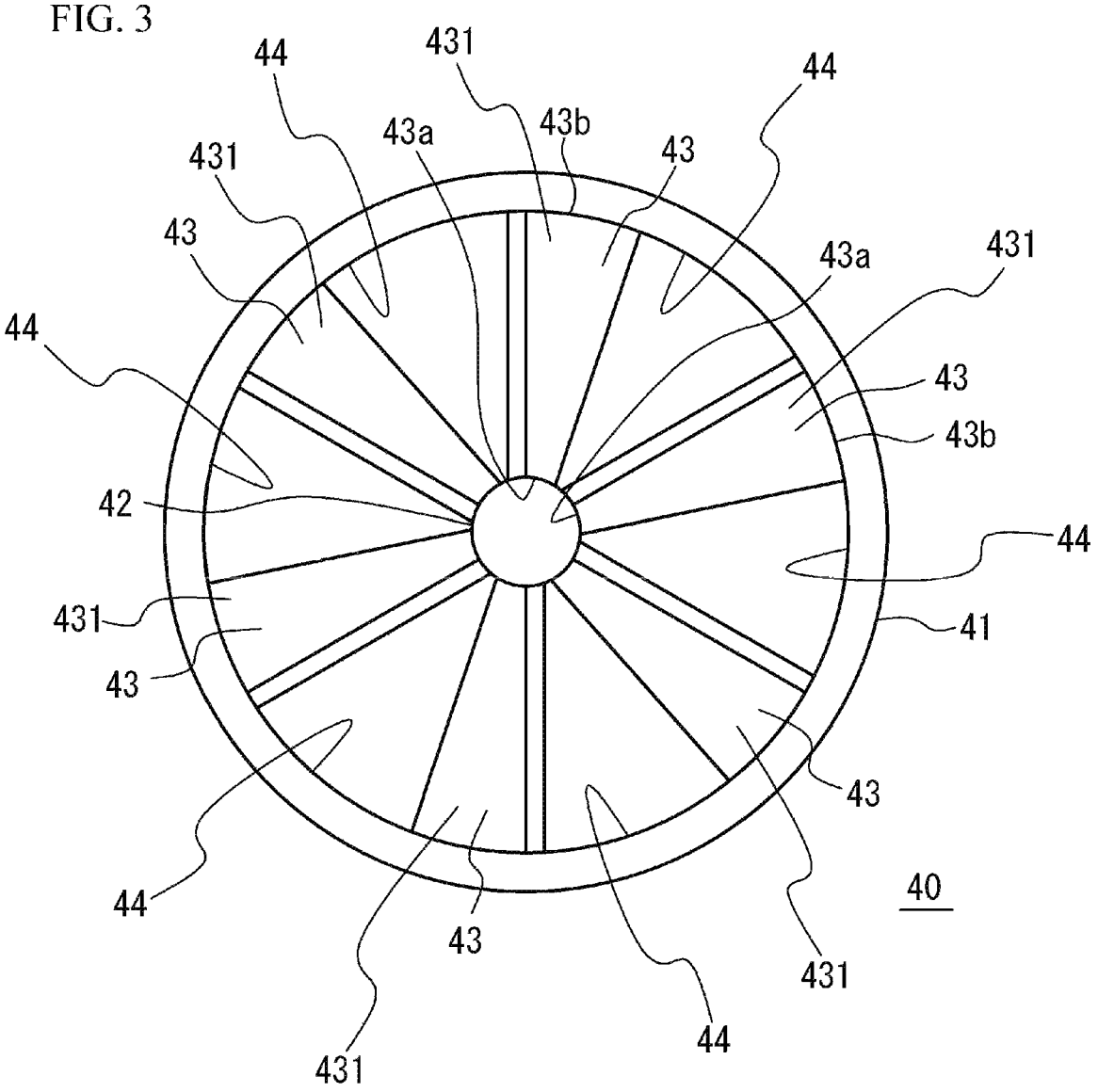
FIG. 3 illustrates a structure in which a nozzle member having blades is seen from an upstream side of a first gas pathway.

The fourth pathway 14 of the supplier 10 has blades 43 for revolving the auxiliary gas for reaction acting as the first gas. FIG. 3 schematically illustrates a structure in which a nozzle member 40 having the blades 43 is seen from an upstream side of the fourth pathway 14 acting as the first gas pathway. The nozzle member 40 has a frame portion 41 having a ring shape and a hub portion 42 arranged in a center portion of the frame portion 41. The blades 43 connect the frame portion 41 and the hub portion 42. The blades 43 are radially formed around the hub portion 42. The blade 43 has an inclined face 431. The inclined face 431 is inclined with respect to a flow direction of the auxiliary gas for reaction in the fourth pathway 14. Thereby, the auxiliary gas for reaction collides with the inclined face 431. With the structure, the blade 43 revolves the auxiliary gas for reaction supplied in the furnace body 2, toward a lower side. In the embodiment, the number of the blade 43 is six. However, the number is not limited when the blades 43 can revolve the auxiliary gas for reaction. An axial direction of the hub portion 42 coincides with the flow direction of the auxiliary gas for reaction in the fourth pathway 14.

In the embodiment, a clearance 44 is formed on a side of the inclined face 431. The clearance 44 communicates an inner portion of the fourth pathway 14 with an inner portion of the furnace body 2. That is, the nozzle member 40 has a structure in which the blade 43 and the clearance 44 are alternately arranged in a circumference direction of the nozzle member 40. Thus, when the auxiliary gas for reaction supplied from the upstream side of the fourth pathway 14 collides with the inclined face 431, the direction of the auxiliary gas for reaction is changed. And, the auxiliary gas for reaction passes through the clearance 44 and is supplied into the furnace body 2 as a revolved flow.

The auxiliary gas for reaction having collided with the inclined face 431 has passes through the fourth pathway 14. Therefore, a vector of the auxiliary gas for reaction has a component directed to a lower side. Accordingly, the auxiliary gas for reaction having collided with the inclined face 431 revolves with a direction to the lower side of the furnace body 2.

Figure 4A:
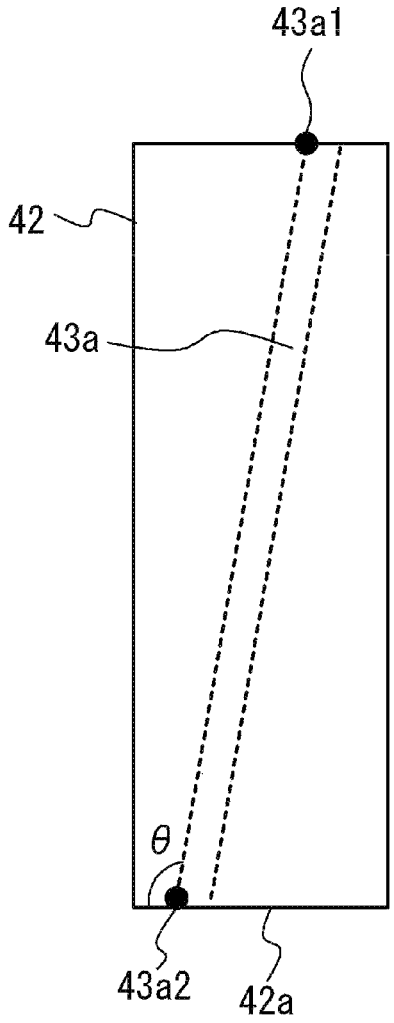
FIG. 4A illustrates an arrangement of a blade with respect to a hub portion of a nozzle member.
Figure 4B:
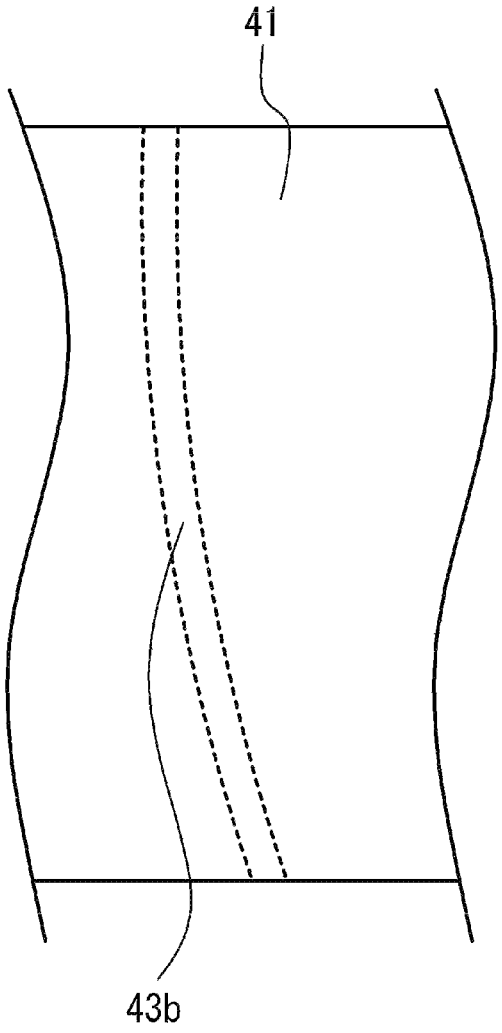
FIG. 4B illustrates an arrangement of a blade with respect to a frame portion of a nozzle member.
Figure 5:
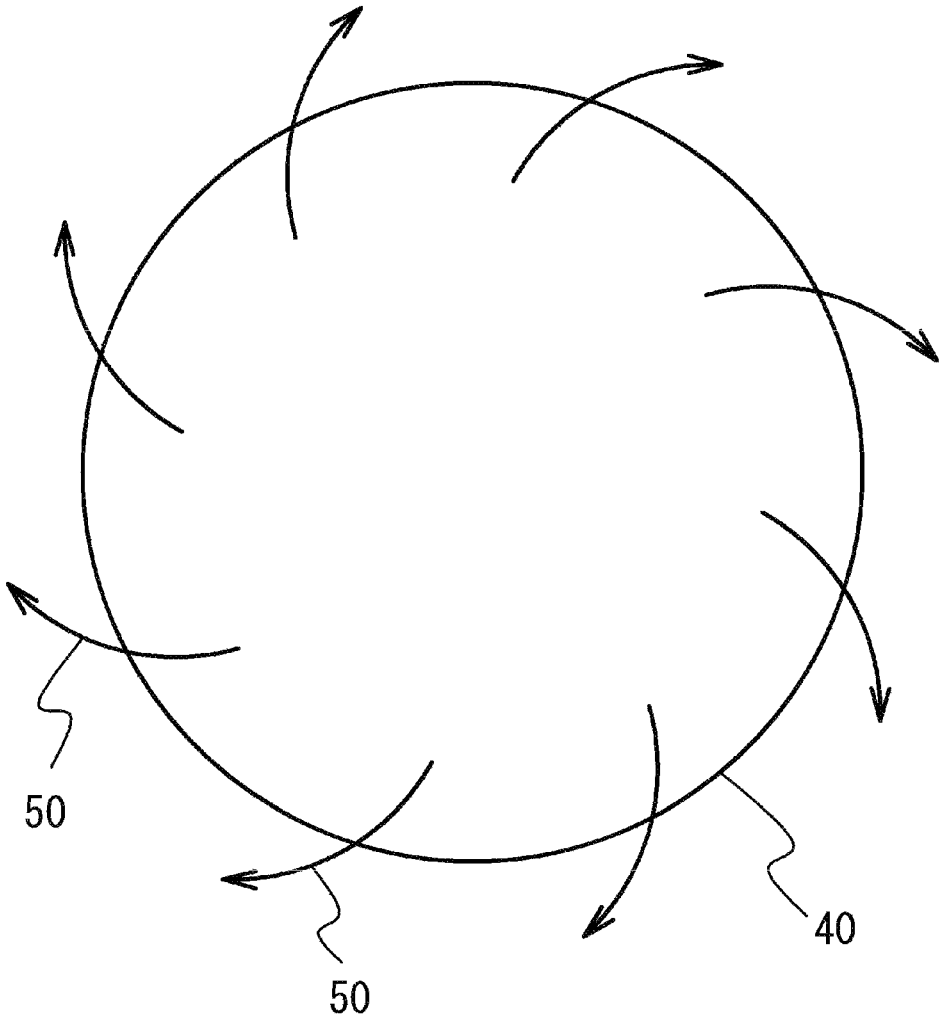
FIG. 5 schematically illustrates a revolved flow blown into a flash smelting furnace.

A description will be given of the blade 43 with FIG. 4A and FIG. 4B. FIG. 4A illustrates an arrangement of the blade 43 with respect to the hub portion 42 of the nozzle member 40. FIG. 4B illustrates an arrangement of the blade 43 with respect to the frame portion 41 of the nozzle member 40.

FIG. 4A illustrates the hub portion 42 having a column shape seen from the frame portion 41 side. An inner edge portion 43*a* of the blade 43 is inclined with respect to the hub portion 42 extending to a vertical direction, as indicated with a dotted line of FIG. 4A. In detail, the inner edge portion 43*a* is arranged with respect to the hub portion 42 so that an angle between a straight line connecting an upper edge portion 43*a*1 of the inner edge portion 43*a* and a lower edge portion 43*a*2 of the inner edge portion 43*a* and a straight line of a lower edge 42*a* of the hub portion 42 extending in a horizontal direction is an angle θ. On the other hand, FIG. 4B illustrates the frame portion 41 seen from the hub portion 42 side. An external edge portion 43*b* of the blade 43 is bent as indicated with a dotted line of FIG. 4B. This is because the shape of the blade 43 is determined so that the auxiliary gas for reaction collided with the surface of the blade 43 becomes a revolved flow.

Figure 6:
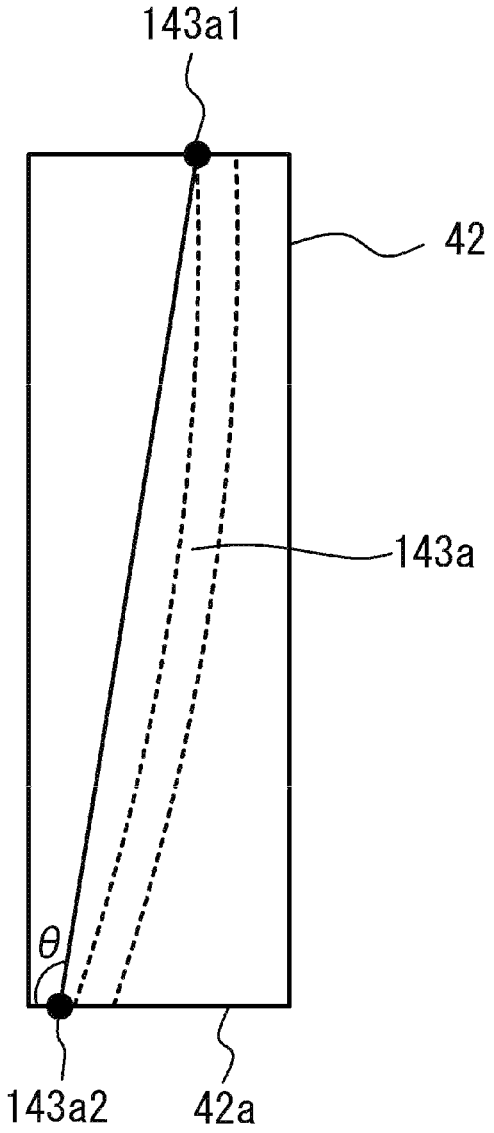
FIG. 6 illustrates an arrangement of a blade with respect to a hub portion of a nozzle member.

The shape of the blade 43 is an example. The shape of the blade 43 is not limited when the blade 43 converts the auxiliary gas for reaction collided with the blade 43 into the revolved flow as indicated with an arrow 50 of FIG. 5 in a case where the downstream side of the fourth pathway 14 is seen from the upstream side of the fourth pathway 14. In FIG. 6, an inner edge portion 143*a* of the blade is bent. And the inner edge portion 143*a* is arranged with respect to the hub portion 42 so that the angle between the straight line connecting an upper edge portion 143*a*1 of the inner edge portion 143*a* with a lower edge portion 143*a*2 of the inner edge portion 143*a* and the line of the lower edge 42*a* of the hub portion 42 extending in the horizontal direction is θ. When the auxiliary gas for reaction collides with the blade having the shape, the auxiliary gas becomes a revolved flow directed to the lower side of the furnace body 2.

In the examples of FIG. 4A and FIG. 6, the inner edge portion of the blade is arranged so that the angle between the straight line connecting the upper edge portion and the lower edge portion and a line of the lower edge 42*a* of the hub portion 42 extending in the horizontal direction is θ. The angle θ is larger than 90 degrees. Thereby, the blade is inclined with respect to the hub portion 42. When the blade is inclined with respect to the hub portion 42, it is easy to revolve the auxiliary gas for reaction collided with the blade. However, the inner edge portion of the blade may not be necessarily inclined with respect to the hub portion 42.

Figure 7:
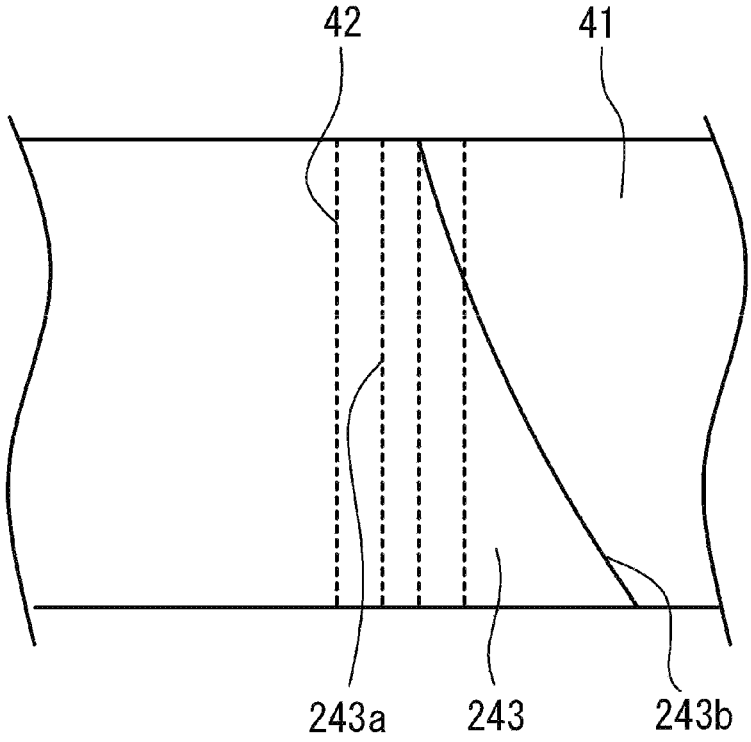
FIG. 7 illustrates another shape of a blade.

An inner edge portion 243*a* of a blade 243 illustrated in FIG. 7 may not be necessarily inclined with respect to the hub portion 42. The extension direction of the inner edge portion 243*a* may coincide with the extension direction of an axis line of the hub portion 42. FIG. 7 illustrates the hub portion 42 and the inner edge portion 243*a* that are projected to an inner circumference face of the frame portion 41 to which an external edge portion 243*b* of the blade 243 is connected. The hub portion 42 and the inner edge portion 243*a* are illustrated with a dotted line. In the example of FIG. 7, the angle corresponding to the angle θ of FIG. 4A and FIG. 6 is 90 degrees. That is, the extension direction of the inner edge portion 243*a* coincides with the extension direction of the axis line of the hub portion 42. In this manner, although the extension direction of the inner edge portion 243*a* coincides with the extension direction of the axis line of the hub portion 42, it is possible to revolve the auxiliary gas for reaction collided with the blade 243 when the blade 243 is bent.

The nozzle member 40 having the blade 43 is arranged at a lower edge portion 14*a* of the fourth pathway 14. The lower edge portion 14*a* of the fourth pathway 14 extends in the furnace body 2. The auxiliary gas for reaction is blown into the furnace body 2 from the lower edge portion 14*a* of the fourth pathway 14. Therefore, when the blade 43 is arranged at the lower edge portion 14*a*, it is possible to effectively blow the revolved auxiliary gas for reaction into the furnace body 2.

In the region just below the raw material supply device 1, a concentration of particles of the concentrate is high. The temperature of the region is low because of the main blow gas for reaction is blown from the third pathway 13. Therefore, it is difficult to progress the concentrate reaction in the region. In the embodiment, the auxiliary gas for reaction is revolved and is blown to the region just below the raw material supply device 1. In this manner, residence time of the revolved flow blown into the furnace body 2 is longer than a flow vertically blown downward in the furnace body 2. The revolved flow can involve the particles of the concentrate from the region just below the raw material supply device 1. It is therefore possible to promote contacting between the concentrate and the auxiliary gas for reaction and promote the reaction just below the raw material supply device 1. In this manner, the raw material supply device 1 can positively promote the mixing between the concentrate acting as a raw material with the gas for reaction and uniformizing the reaction.

The nozzle member 40 having the blade 43 is mounted at the lower edge portion 14*a* of the fourth pathway 14 and is fixed at the lower edge portion 14*a*. It is therefore possible to arrange the blade 43 easily. The nozzle member 40 is detachable. It is therefore possible to perform a maintenance of the blade 43.

The present invention is not limited to the specifically disclosed embodiments and variations but may include other embodiments and variations without departing from the scope of the present invention.

What is claimed is:

1. A raw material supply device that supplies a raw material into a flash smelting furnace and supplies first gas and second gas into the flash smelting furnace, the first gas and the second gas contributing to reaction of the raw material, comprising:

a lance in which a first gas pathway for supplying first gas into the flash smelting furnace and a pathway for supplying gas for dispersion into the flash smelting furnace are provided, the pathway surrounding the first gas pathway;

a raw material pathway that is provided out of the lance and supplies the raw material into the flash smelting furnace;

a second gas pathway that is provided out of the raw material pathway and supplies the second gas into the flash smelting furnace; and a blade that is provided in the first gas pathway, has an inclined face with which the first gas collides and revolves the first gas toward a lower side of the flash smelting furnace, the inclined face being inclined with respect to a flow direction of the first gas in the first gas pathway wherein the blade is provided between a ring-shaped frame provided in the first gas pathway and a hub portion provided in a center portion of the frame portion.

2. The raw material supply device as claimed in claim 1, wherein the blade is provided at a lower edge of the first gas pathway.

* * * * *